United States Patent [19]

Hanyu et al.

[11] Patent Number: 4,693,193

[45] Date of Patent: Sep. 15, 1987

[54] DEVICE OF GUIDING DRAWING-OUT OF A LOWER THREAD FROM A HORIZONTAL BOBBIN CARRIER OF A SEWING MACHINE

[75] Inventors: Susumu Hanyu; Kazumasa Hara, both of Tokyo; Akiyoshi Sasano, Musashino; Mikio Koike, Oume, all of Japan

[73] Assignee: Janome Sewing Machine Co. Ltd., Tokyo, Japan

[21] Appl. No.: 783,751

[22] Filed: Oct. 3, 1985

[30] Foreign Application Priority Data

Oct. 5, 1984 [JP] Japan ..... 59-208300

[51] Int. Cl.[4] ..... D05B 3/02; D05B 19/00; D05B 57/26

[52] U.S. Cl. ..... 112/121.11; 112/121.13; 112/184; 112/243; 112/458; 112/467

[58] Field of Search ..... 112/181, 184, 191, 242, 112/243, 467, 454, 458, 121.11, 121.13

[56] References Cited

U.S. PATENT DOCUMENTS 1,983,263 12/1934 Allen et al. ..... 112/242
2,438,833 3/1948 Wood ..... 112/242
4,091,753 5/1978 Johnson et al. ..... 112/184
4,215,639 8/1980 Johnson ..... 112/242
4,355,590 10/1982 Ketterer ..... 112/184

*Primary Examiner*—Wm. Carter Reynolds
*Attorney, Agent, or Firm*—Michael J. Striker

[57] ABSTRACT

A lower thread drawing-out device for a computerized sewing machine, the device having a cup-shaped loop taker with a surrounding wall. The loop taker is rotatable in a timed relation with a vertical reciprocation of the needle to catch the upper thread to concatenate with the lower thread and thereby form lock stitches. A bobbin is arranged in the loop taker so as to form a space between the bobbin and the loop taker surrounding wall. A lower thread drawing out element having a free end in the space is arranged so that when a lower thread is wrapped around the bobbin and extends to a needle, the free end contacts the lower thread at a location. The lower thread drawing out element is rotatable relative to the loop taker. The lower thread is movable transversely at the contact location relative to the lower thread when extended and in response to a rotation of the element relative to the loop taker, thereby compensating for biasing of the lower thread.

8 Claims, 16 Drawing Figures

14. Fabric selecting device
12. Pattern selecting device
13. Thread selecting device
11. Lower thread drawing out step motor
15. Pattern stitching step motor 14. Fabric selecting device
12. Pattern selecting device
13. Thread selecting device
11. Lower thread drawing out step motor
15. Pattern stitching step motor

DEVICE OF GUIDING DRAWING-OUT OF A LOWER THREAD FROM A HORIZONTAL BOBBIN CARRIER OF A SEWING MACHINE

FIELD OF THE INVENTION

This invention relates to a device which controls drawing-out of a lower thread in response to stitching conditions of a sewing machine, and more particularly to a device of guiding said drawing-out of the lower thread from a horizontal bobbin carrier of a sewing machine.

BACKGROUND OF THE INVENTION

In forming stitches, a lower thread drawing-out device is one of the important mechanisms of the sewing machine, which draws out in advance an amount of the lower thread required to form the stitches, and tightens upper and lower threads crossing each other within the thickness of a fabric under stitching at an upper dead point phase of a thread take-up lever.

In a conventional sewing machine having the horizontal bobbin carrier, the lower thread is drawn out by vertical movement of a lower thread drawing out device 2 provided at a feed dog 100 as seen in FIG. 4.

The foregoing method of drawing out the lower thread depends upon the actuation of the feed dog, and is difficult to obtain desired effects. For incorporating a device to be used to draw out the lower thread into the sewing machine, a very minor space is utilized in relation with a bobbin 4 and stitches 5 as noted in FIG. 1. Therefore, said device could not display sufficient function.

In zigzag stitching, the lower thread is biased to one side of the zigzag width due to relative position between the guiding position of the lower thread from the bobbin and the needle dropping. Causes of said biasing of the lower thread may be summarized as such a case that in the straight stitching the lower thread is, as shown in FIG. 5, supplied from the left side of a bobbin carrier 16 in order to avoid hitch stitching and secure perfect stitch, so that the required amount of the lower thread is changed when the stitches are formed by dropping the needle at the left and at the right in the zigzag stitching as shown in FIG. 6 to FIG. 7. That is, the required amount thereof in the needle dropping at the right side is $\overline{AL_1}.\ \overline{AR_1}.\ \overline{C_1} - \overline{AL_1}.\ \overline{C_1}$, while the required amount in the needle dropping at the left side is $\overline{AR_2}.\ \overline{AL_2}.\ \overline{C_2} - \overline{AR_2}.\ \overline{C_2}$. Thus, the required amount of the lower thread in the needle dropping at the right side is larger than at the left side.

For avoiding said biasing, the lower thread 6 is passed through a center of the bobbin carrier 16, however in this case when the needle drops at the left side, the hitch stitching is caused.

In view of these circumstances, the straight stitching and the zigzag stitching require different lower thread guiding positions respectively. However it has been conventionally difficult to incorporate the lower thread guiding device in the narrow spaces as said above.

BRIEF DESCRIPTION OF THE INVENTION

The present invention has been devised to solve the above mentioned problems by incorporating a device of drawing out the lower thread in a narrow space between the bobbin chamber and the stitches, and the drawing-out part is controlled by a stepping motor installed at the outside of a loop taker via a drawing-out shaft passing through a hollow part provided on a shaft of the loop taker 8 of the horizontal bobbin carrier. The loop taker 8 hooks a thread loop at its part 8*a*.

The lower thread drawing-out part and the stepping motor are connected via the drawing-out shaft mounted on the hollow part of the shaft of the loop taker, and the drawing-out part is driven by an order per each of pulses in synchronism with rotation of the upper shaft. This drawing-out device may be controlled as the lower thread guiding device by an order of pattern selection.

DETAILED DESCRIPTION OF PREFERRED EMBODIMENTS OF THE INVENTION

Figure 3:
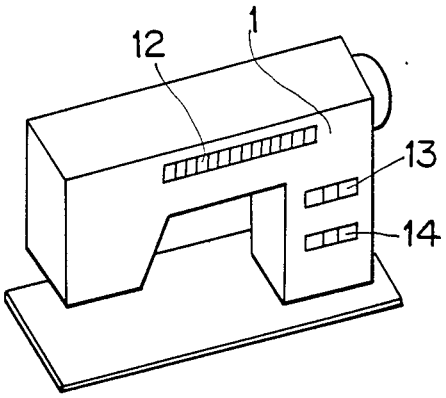
FIG. 3 is an outer appearance of a sewing machine incorporated with the present lower thread drawing-out device.
Figure 4:
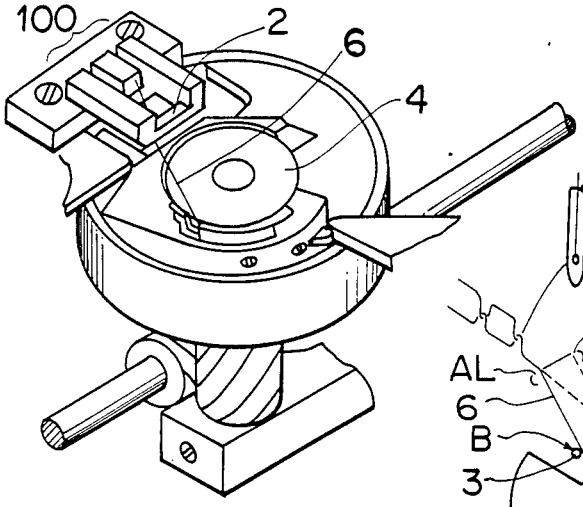
FIG 4 PRIOR ART
FIG. 4 is a perspective view of a part of drawing out the lower thread of a conventional example.

FIG. 3 illustrates a computerized sewing machine which is provided on a machine frame 1 thereof with a pattern selection device 12 with pattern selecting switches, a thread thickness selection device 13, and a fabric sort selection device 14 with stitch condition selecting switches for automatically providing the optimum stitching conditions.

Figure 1:
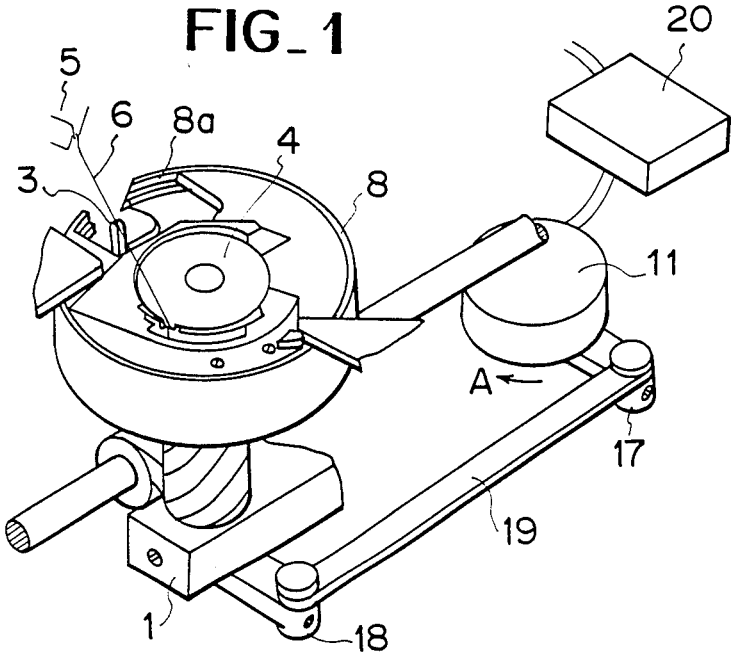
FIG. 1 is a perspective view of a device of drawing out a lower thread according to the present invention.
Figure 2:
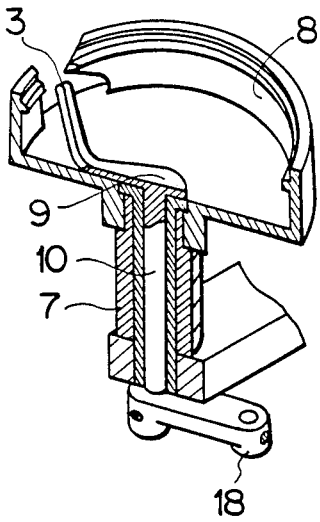
FIG. 2 is an element part, partially in section, of the present device.

With respect to a device for drawing out the lower thread, a machine frame 1 is, as shown in FIGS. 1 and 2, installed with a shaft 7 of a loop taker 8, which is defined with a hollow passage where a guide shaft 10 runs and contacts to a guide body 9 at its one end and is connected to a link 18 at its other end, said link 18 being connected, via a rod 19, to a stepping motor 11 for drawing out a lower thread, having a link 17. The stepping motor 11 is electrically connected to a central processing unit of a microcomputer 20 which calculates information from each of said devices 12, 13 and 14.

Figure 9:
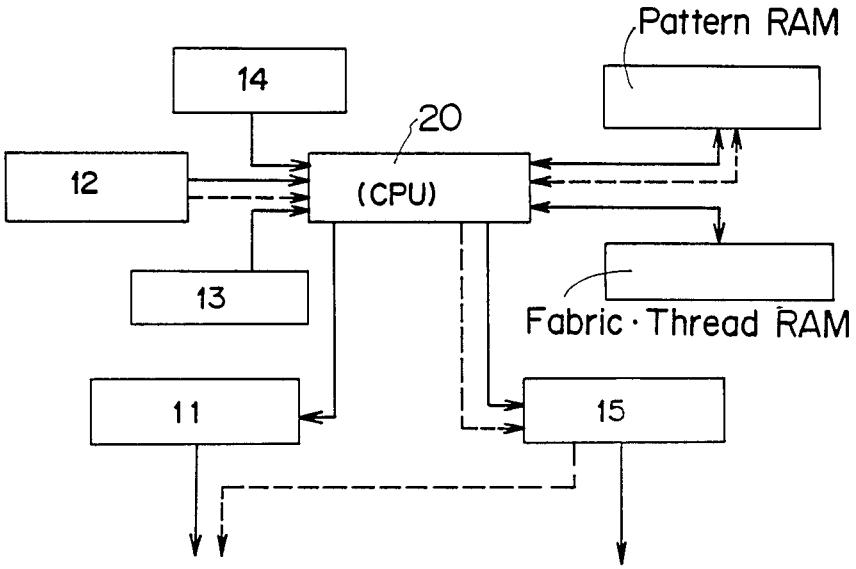
FIG. 9 is a flow chart for explaining actuations of the invention.

Controlling of the lower thread will be explained with reference to a flow chart of FIG. 9. The information from said devices 11, 12 and 13 is read in said central processing unit 20, and stored in a pattern RAM and a fabric thread sort RAM respectively, and a pattern forming stepping motor 15 is worked to form patterns, and an amount of drawing out the lower thread is calculated in the central processing unit 20 in accordance with signals from said pattern RAM and said fabric, thread sort RAM so as to actuate said lower thread drawing-out stepping motor 11.

The stepping motor 11 is rotated in the direction of an arrow A in FIGS. 1 and 2 to drive the link 17, the rod 19 and the link 18. When a thread drawing-out part 3 of the guide body 9 is moved from a position B of FIG. 10 to a position D so that the lower thread 6 is moved to a lower thread 6*a* as seen in the same, and in such a manner the lower thread is drawn out from a bobbin 4 via said route. The lower thread 6a may also be released back to position B of FIG. 10 from position D by moving the lower thread drawing-out part in the opposite direction from before.

Figure 10:
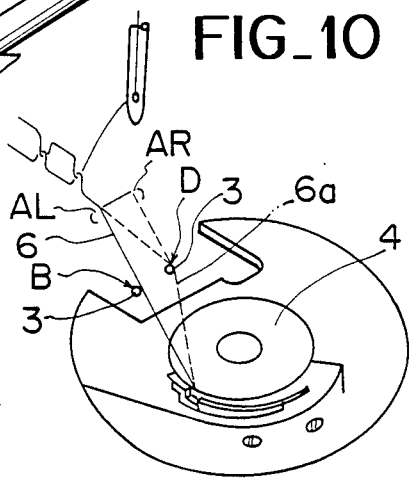
FIG. 10 is an explanatory view for drawing out the lower thread.
Figure 5:
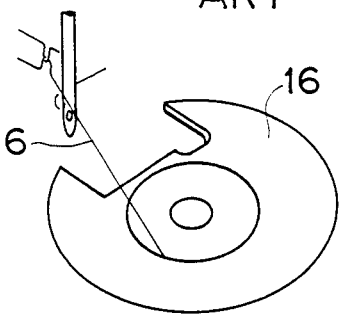
FIG 5 PRIOR ART
FIGS. 5 to 8 are explanatory views of positions of guiding the lower thread in the conventional examples.
Figure 8:
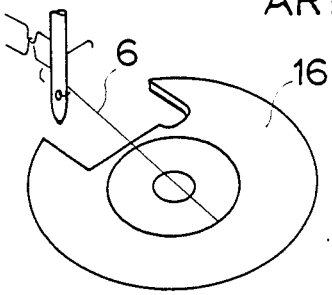
FIG 8 PRIOR ART
Figure 6:
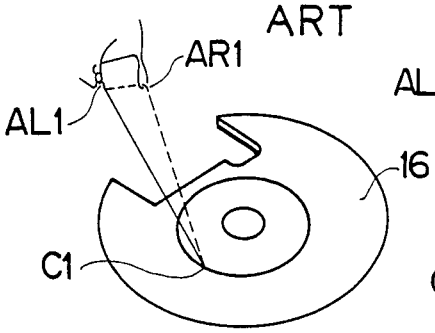
FIG 6 PRIOR ART
Figure 7:
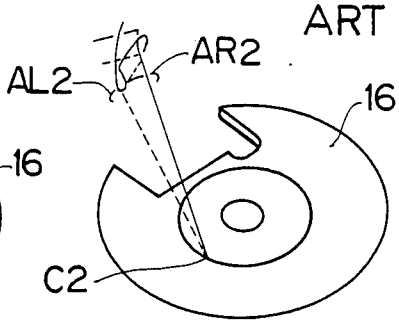
FIG 7 PRIOR ART

If the stepped motor 11 is rotated in opposition to the arrow A, the drawing-out part 3 is returned to the position B of FIG. 10 to loosen the lower thread 6 for supplying it when required. This supplying amount is varied by each of stitchings and the required amount is determined by controlling rotation angle of the stepping motor 11.

When the present device of the invention is used for guiding the lower thread, the position of the solid line of FIG. 10 is for the straight stitching, and that of the dotted line is for the zigzag stitching. The guide part 3 of drawing out the lower thread is positioned by selecting the patterns.

Figure 11:
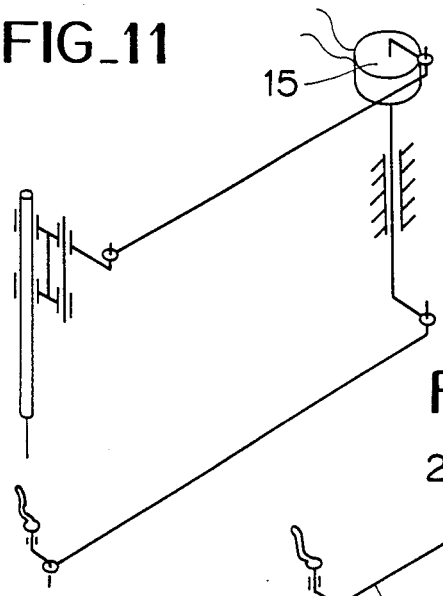
FIG. 11 is another embodiment relating to an external driving for drawing out the lower thread.

Another embodiment of drawing out the lower thread substitutes a pattern forming stepping motor 15 as shown in FIG. 11 for said stepping motor 11, and drives the guide body 9 via the link and rod. The lower thread is drawn out in response to amplitude of the needle so as to meet the drawing-out amount per each of the needle droppings to a value of the amplitude amount.

Figure 12:
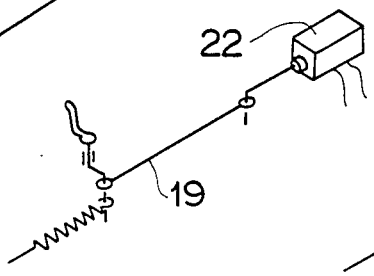
FIG. 12 is a further embodiment relating to an external driving therefor by Solenoid.

A further embodiment is used only to prevent the lower thread from biasing to one side, where Solenoid 22 may be used as shown in FIG. 12 in place of said stepping motor 11 or 15.

Figure 13:
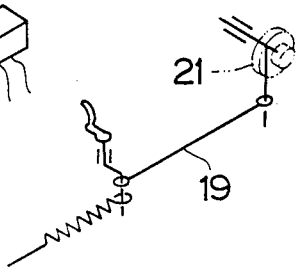
FIG. 13 is another embodiment relating to an external driving therefor by a mechanical drive.

A still furthe embodiment, as shown in FIG. 13, connects the lower thread drawing-out device 3 to a pattern selection part 21 of an existing mechanical sewing machine via the rod 19 and the link.

Figure 14:
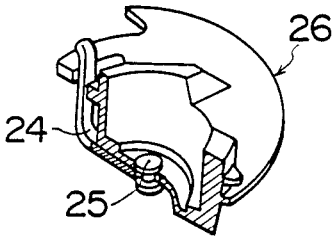
FIG. 14 is a bobbin carrier relating to another embodiment for drawing out the lower thread.
Figure 15:
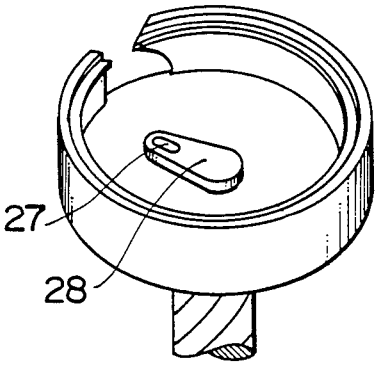
FIG. 15 is an embodiment of the above relating to a driving part for guiding the lower thread.
Figure 16:
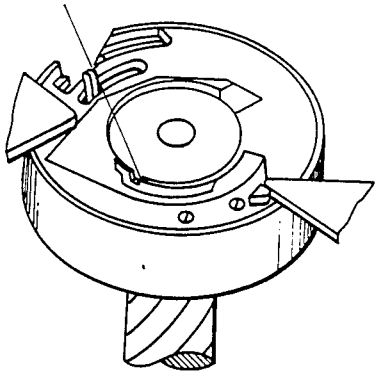
FIG. 16 is an outer appearance of setting up the above embodiment.

FIGS. 14 to 16 show another embodiment of the invention. A lower thread drawing out element 24 is made of magnetizable material such as iron and pivots via pivot pin 25 on the bottom of a bobbin carrier 26, which carries bobbin 4. Element 24 is accomodated by the cup-shaped loop taker so as to be prevented from rotating. An arm 28 has one end secured to guide shaft 10 (which is depicted in FIG. 2) and another end having a magnet 27 mounted thereon. Thus, it should be apparent that during operation, lower thread drawing element 24 moves in accordance with the swinging movement of arm 28.

What is claimed is

1. A lower thread drawing out device for a computerized sewing machine that includes a needle which is laterally swingable relative to a fabric feeding direction so as to have one needle position at any one time, the needle being formed to carry an upper thread and being vertically reciprocable relative to a fabric to be sewn for penetrating the fabric to be sewn and to concatenate the upper thread with a lower thread to thereby produce lock stitches in a fabric, the lower thread device comprising:

a cup-shaped loop taker with a surrounding wall with a portion formed as an edge in a beak shape for catching thread, said loop taker being rotatable in a timed relation with a vertical reciprocation of the needle to catch the upper thread to concatenate with the lower thread to thereby form lock stitches;

a bobbin positioned in said loop taker so as to form as space between said surrounding wall of said loop taker and said bobbin, said bobbin being formed to be wound therearound by a lower thread, said loop taker being formed so that the lower thread is extendable between said bobbin and the needle position, said bobbin being arranged so that the lower thread biases in dependence upon the relative position of the needle positon to the bobbin; and means for drawing-out a lower thread to compensate for a biasing of a lower thread relative to said bobbin by the needle position and including a lower thread drawing out element having a free end, said element extending radially and outwardly from said loop taker and terminating at said free end, said free end being arranged in said space between said surrounding wall of said loop taker and said bobbin and being arranged to contact a lower thread between said bobbin and the needle position when the lower thread is extended therebetween, said element and therefore said free end being rotatably movable relative to said loop taker to compensate for said biasing of the lower thread relative to said bobbin by the needle position so that the lower thread is movable in association with said free end.

2. A device as defined in claim 1, wherein said loop taker has a rotation center area about a rotation axis when rotating, said lower thread drawing-out element having one end located at said rotation center area opposite said free end, said lower thread drawing-out means further includes connecting means connected to said lower thread drawing-out element and rotatably movable relative to said loop taker and including a vertically arranged shaft located along said rotation axis of said loop taker, said loop taker having a hollow member located around said vertical shaft and being rotatable relative to the latter, said vertical shaft having an upper end connected to said one end of said lower thread drawing-out element.

3. A device as defined in claim 2, wherein said vertical shaft also has a lower end, said thread drawing out means further including means for rotatably moving said connecting means, said rotatably moving means including a second actuator operatively connected to said lower end.

4. A device as defined in claim 3, wherein said second actuator is formed as a stepping motor.

5. A device as defined in claim 2, wherein said lower thread drawing-out element is composed of a magnetizable material at least at said one end thereof; further comprising:

a magnet secured to said upper end of said vertical shaft so that said upper end of said vertical shaft is connected to said one end of said lower thread drawing-out element via a magnetic attraction between said magnetizable material and said magnet.

6. A lower thread drawing out device for a computerized sewing machine that includes a needle which is laterally swingable relative to a fabric feeding direction, the needle being formed to carry an upper thread and being vertically reciprocatable for penetrating a fabric to be sewn and to concatenate the upper thread with a lower thread to thereby produce lock stitches in a fabric from stitch formation cycles, the computerized sewing machine also including a microcomputer with memory that stores stitch control data associable with a plurality of different stitch patterns and stores stitch condition data associable with types of threads to be used and types of fabrics to be sewn, the stitch control data being selectively readable out from the memory, means for controlling a needle position in response to stitch control data read out from the memory and including a first actuator, means for selecting a pattern corresponding to a respective one of the plurality of different stitch patterns associable with stored stitch control data and including a plurality of pattern selecting switches selectively operable, and means for stitch condition selecting corresponding to at least one of the thread and fabric types associable with stored stitch condition data and including a plurality of stitch condition selecting switches selectively operable, the lower thread drawing out device comprising:

first means responsive to a selective operation of the pattern selecting switches for temporarily memorizing the stitch control data from the memory specific to a corresponding selected stitch pattern;

second means responsive to a selective operation of the stitch condition selecting switches for temporarily memorizing the stitch condition data from the memory specific to a corresponding type of one of the thread and fabric types;

calculating means responsive to each of the stitch formation cycles for making calculations from the specific stitch control data and the specific stitch condition data, said calculating means thereafter producing a corresponding control output;

means responsive to said control output of said calculating means and including a second actuator controllable in response to said control output;

a cup-shaped loop taker with a vertically arranged surrounding wall with a portion formed as a beak for catching upper thread, said loop taker being rotatable in a timed relation with a vertical reciprocation of the needle to catch the upper thread to concatenate with the lower thread to thereby form lock stitches and having a rotation center area and a hollow shaft vertically arranged at said rotation center area;

a bobbin positioned in said loop taker so as to form as space between said vertical surrounding wall of said loop taker and said bobbin, said bobbin being formed to be wound therearound by a lower thread, said loop taker being formed so that the lower thread is extendable between said bobbin and the needle position; and means for drawing-out a lower thread to compensate for a biasing of a lower thread relative said bobbin by the needle position and including a lower thread drawing-out element having one end at said rotation central area of said loop taker and having a free end, said element extending radially and upwardly from said loop taker and terminating at said free end, said free end being arranged in said space between said vertical surrounding wall of said loop taker and said bobbin and being arranged to intersect with a lower thread between said bobbin and the needle position when the lower thread is extended between the bobbin and the needle position, said drawing-out means also including a vertical shaft positioned within said hollow shaft of said loop taker and being rotatable relative to the latter, said vertical shaft having an upper end connected to said one end of said lower thread drawing out element and having a lower end operatively connected to said second actuator so that said element is rotatably movable relative to said loop taker to compensate for biasing of a lower thread relative to said bobbin by the needle position.

7. A device as defined in claim 6, wherein said second actuator is formed as a stepping motor.

8. A device as defined in claim 6, wherein said lower thread drawing-out element is composed of a magnetizable mateial at least at said one end thereof; further comprising:

a magnet secured to said upper end of said vertical shaft so that said upper end of said lower thread drawing-out element via a magnetic attraction between said magnetizable material and said magnet.

* * * * *